US005700169A

United States Patent [19]

Jones

[11] Patent Number: 5,700,169

[45] Date of Patent: Dec. 23, 1997

[54] INLET ADAPTER FOR A PERSONAL WATERCRAFT

[75] Inventor: James R. Jones, Neosho, Wis.

[73] Assignee: Brunswick Corporation, Lake Forest, Ill.

[21] Appl. No.: 717,915

[22] Filed: Sep. 23, 1996

[51] Int. Cl.[6] ..... B63H 11/01

[52] U.S. Cl. ..... 440/46; 440/38

[58] Field of Search ..... 440/38, 46, 47; 114/270; 60/221, 222; 244/53 B

[56] References Cited

U.S. PATENT DOCUMENTS

| | | | |
|---|---|---|---|
| 3,040,695 | 6/1962 | Austin | 440/46 |
| 3,083,529 | 4/1963 | Hamilton | 60/221 |
| 4,027,617 | 6/1977 | Ikeda et al. | 115/14 |
| 4,237,812 | 12/1980 | Richardson | 440/38 |
| 4,378,097 | 3/1983 | Ferguson et al. | 244/53 B |
| 4,775,341 | 10/1988 | Tyler et al. | 440/38 |
| 4,971,584 | 11/1990 | Inoue et al. | 440/38 |
| 5,224,887 | 7/1993 | Futaki | 440/46 |
| 5,234,361 | 8/1993 | Dickinson et al. | 440/38 |
| 5,240,443 | 8/1993 | Futaki | 440/38 |
| 5,281,177 | 1/1994 | Dickinson et al. | 440/47 |
| 5,324,216 | 6/1994 | Toyohara et al. | 440/47 |
| 5,330,374 | 7/1994 | Ishino | 440/38 |
| 5,401,198 | 3/1995 | Toyohara et al. | 440/47 |

FOREIGN PATENT DOCUMENTS

| | | | |
|---|---|---|---|
| WO 92/20573 | 11/1992 | WIPO | 440/38 |

*Primary Examiner*—Edwin L. Swinehart

*Attorney, Agent, or Firm*—Andrus, Sceales, Starke & Sawall

[57] ABSTRACT

An inlet adapter for a personal watercraft jet propulsion system is hydrodynamically designed to achieve optimum performance at both low and high watercraft speeds. The inlet adapter provides an inlet opening having a fixed geometry. A plurality of tines extend from the inlet adapter rearward to cover an inlet opening through which water is pumped to a jet propulsion system. The aft portion of each tine has an exposed face that is blunt, preferably flat. The blunt face restricts water flow through the inlet opening at relatively high speeds, thereby improving high speed performance. The tines are also designed to facilitate laminar flow as the flow of water passes the tines en route to the jet propulsion system. In another aspect, the invention provides a hydrodynamic bulge downstream of the downstream edge of the inlet opening. The hydrodynamic bulge draws sea water accumulating in front of the downstream edge of the inlet opening downward when the watercraft is moving at relatively high speeds, thus reducing drag on the watercraft.

7 Claims, 4 Drawing Sheets

INLET ADAPTER FOR A PERSONAL WATERCRAFT

FIELD OF THE INVENTION

The invention relates to jet propulsion systems for personal watercraft. In particular, the invention relates to a fixed inlet adapter system that is hydrodynamically designed to achieve optimum performance at both low and high watercraft speeds.

BACKGROUND OF THE INVENTION

Jet drives for personal watercraft typically have an engine driven jet pump located within a duct in the hull of the watercraft. A jet of water exits rearward of the watercraft to propel the watercraft. An inlet opening for an intake housing is positioned on the underside of the watercraft and allows sea water to flow to the pump in the duct. The jet pump generally consists of an impeller and a stator located within the duct followed by a nozzle. The impeller of the pump is driven by the engine and provides energy to the flow of sea water through the pump. The sea water then flows through the stator and the nozzle before exiting rearward through a generally tubular rudder that can rotate to steer the watercraft.

An inlet adapter is typically used to adapt the intake housing to the hull on the bottom of the watercraft. The inlet adapter closes off the bottom of the watercraft yet allows sea water to pass through the inlet opening into the pump. The inlet adapter usually has a screen, grate or tines to keep debris from flowing through the inlet opening into the pump. Inlet adapters also act as safety guards.

The inlet adapter is hydrodynamically critical with respect to processing sea water flowing into the jet pump. The inlet adapter should be able to perform satisfactorily over a wide range of operating speeds. For instance, the inlet adapter should allow water into the pump easily when the watercraft is still or moving slowly because the operator may want to accelerate the watercraft. When the watercraft is still or moving slowly, the pump is sucking sea water into the impeller, and blowing accelerated sea water rearward through the nozzle and rudder to accelerate the watercraft. At high speed, on the other hand, the watercraft is actually moving faster than the water flowing into the pump. At high speeds, an excessive amount of sea water can enter the intake housing through the inlet opening and can become resistance or drag on the watercraft, therefore preventing the watercraft from achieving maximum top speed. For overall performance, it is important to allow as much sea water as possible through the inlet opening at slow speeds, and restrict the flow of sea water through the inlet opening at high speeds.

SUMMARY OF THE INVENTION

The invention is a fixed inlet adapter system having a hydrodynamic design to facilitate optimum watercraft performance at both high speeds and low speeds. The invention reduces drag on the watercraft at high speeds, yet allows optimum sea water intake when the watercraft is still or at slow speeds.

An inlet adapter in accordance with the invention is attached to the underside of the watercraft. The inlet adapter provides an inlet opening having a fixed size which leads to the intake duct for the pump. The upstream wall of the inlet adapter slopes gradually upward towards the intake duct. The inlet adapter has a crescent-shaped downstream wall which in addition to the upstream wall helps direct the flow of water uniformly towards the pump impeller. The lower edge of the inlet opening is radiused along the downstream wall and along the sidewalls of the inlet adapter. The radiused edge allows for maximum water intake when the watercraft is stopped or moving at relatively slow speeds.

A plurality of tines extend longitudinally from the upstream wall of the inlet adapter rearward to cover the inlet opening. Preferably, the tines are not structurally connected to the downstream edge of the inlet opening. The tines can be integral with the inlet adapter or can be part of a detachable tine assembly. Each tine has a face that is exposed to the flow of sea water flowing into the inlet opening. At least the aft portion of the tines has an exposed face that is blunt, preferably flat. While the blunt face does not substantially reduce fluid flow through the inlet opening at relatively low speeds, the blunt face substantially restricts the amount of water flowing in through the inlet opening at relatively high speeds. The primary purpose of the blunt face on the tines is to hydrodynamically restrict the flow of sea water into the inlet opening when the watercraft is moving forward at a speed faster than the impeller can pump the sea water.

Each tine preferably has a pair of converging side surfaces extending generally upward from the blunt tine face. The converging side surfaces help to maintain a laminar (or at least less turbulent) flow as the water flows beyond the tines into the intake duct towards the pump. Facilitating a laminar flow through the intake duct helps to improve pump efficiency.

In another aspect, the invention provides a hydrodynamic downward bulge adjacent the downstream edge of the inlet opening. The hydrodynamic downward bulge creates a low pressure region that reduces stagnation in front of the downstream edge of the inlet opening. The hydrodynamic bulge reduces drag on the watercraft that can develop due to water accumulating in front of the downstream edge of the inlet opening when the watercraft is moving forward at relatively high speeds.

Other features and advantages of the invention may be apparent to those skilled in the art upon inspecting the following drawings and description thereof.

DETAILED DESCRIPTION OF THE PREFERRED EMBODIMENTS

Figure 1:
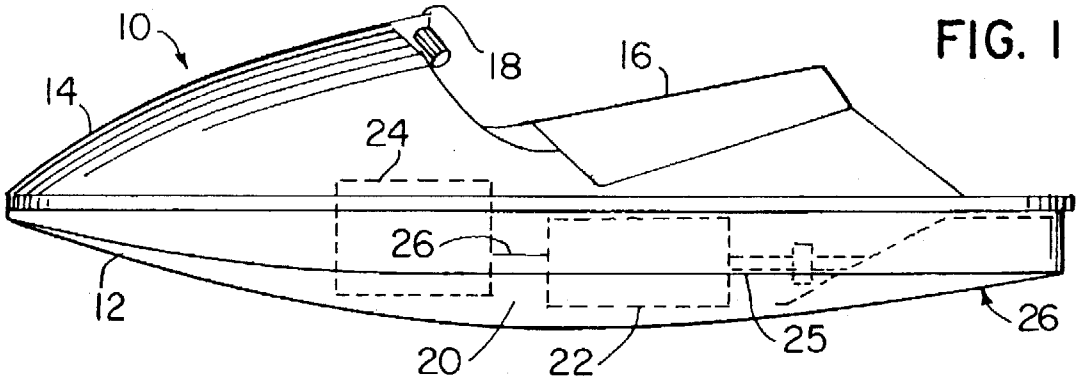
FIG. 1 is a schematic drawing illustrating a personal watercraft.

FIG. 1 shows a personal watercraft 10. The personal watercraft has a hull 12 and a deck 14, both preferably made of fiber reinforced plastic. A driver and/or passenger riding on the watercraft 10 straddles a seat 16. The driver steers the watercraft 10 using a steering assembly 18 located forward of the seat 16.

An engine compartment 20 is located between the hull 12 and the deck 14. A gasoline fueled internal combustion engine 22 is located within the engine compartment 20. A fuel tank 24 is located forward of the engine 22. The engine 22 receives fuel from the fuel tank 24 through a fuel line 26. The engine 22 has an output shaft 25 that is coupled to a jet pump located rearward of the engine 22 generally in the vicinity shown by arrow 26.

Figure 2:
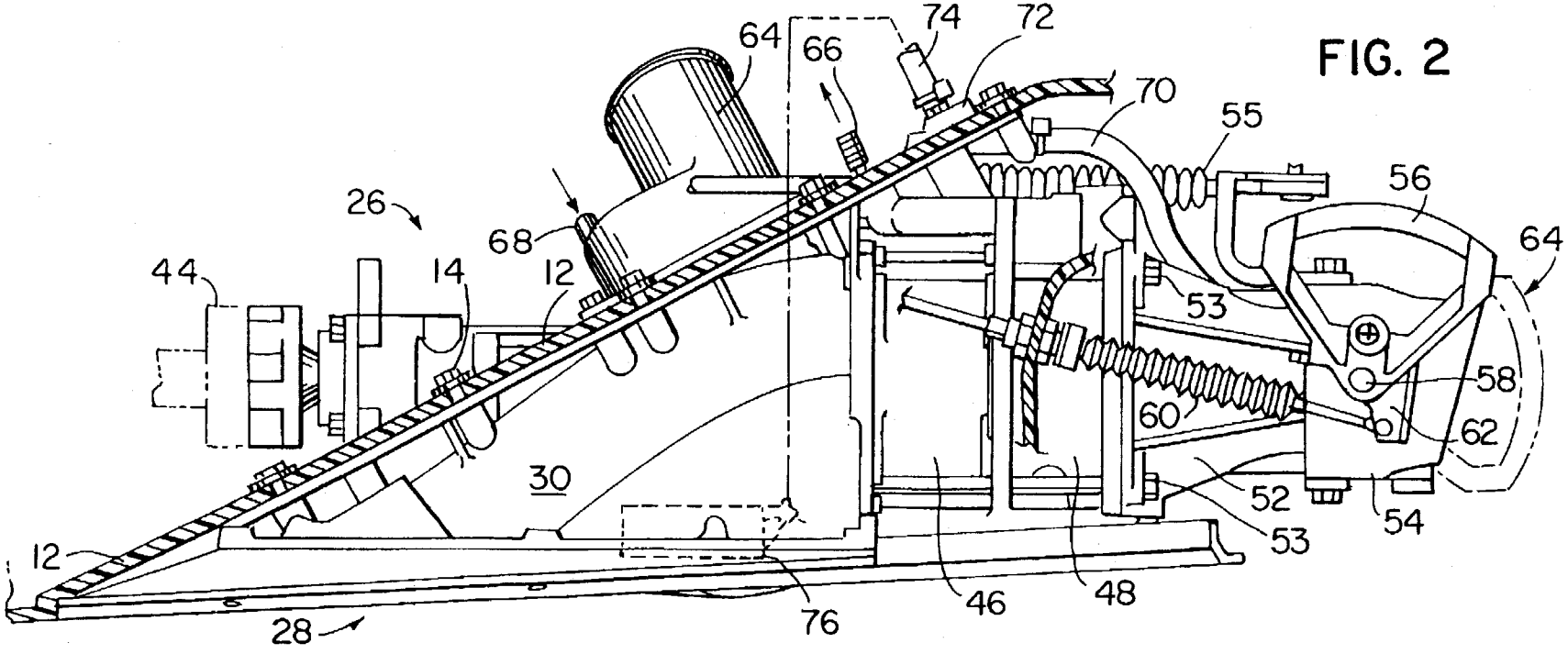
FIG. 2 is a side view of a jet pump assembly for propelling the watercraft in FIG. 1.
Figure 3:
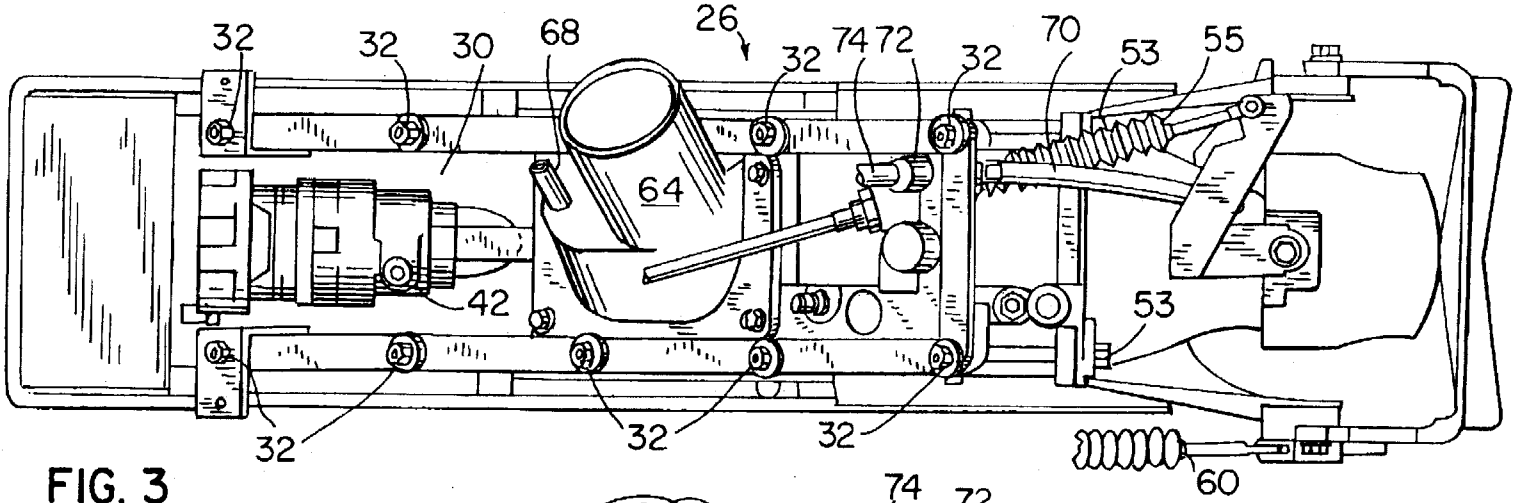
FIG. 3 is a top view of the jet pump assembly shown in FIG. 2.
Figure 4:
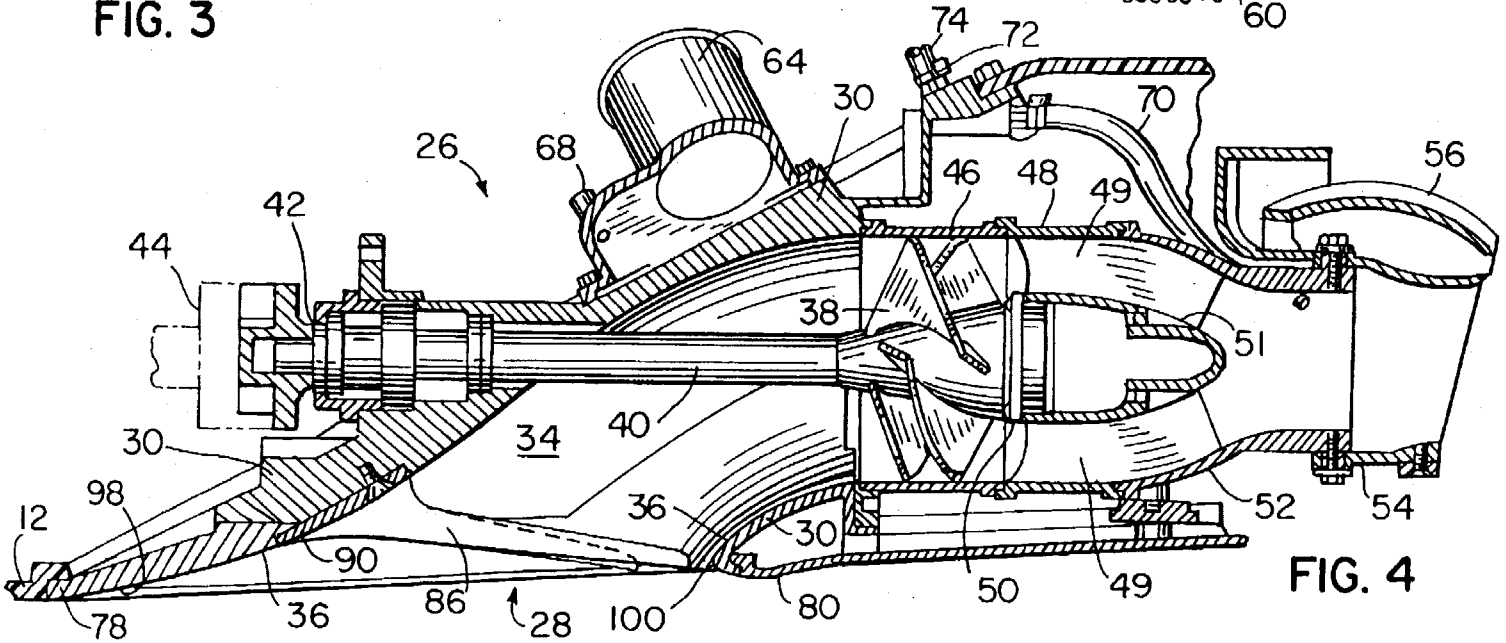
FIG. 4 is a sectional view of the jet pump in FIG. 2 showing an inlet adapter in accordance with the invention.

FIGS. 2–4 show a jet pump 26 using an inlet adapter system 28 in accordance with the invention. The pump 26 includes an intake housing 30 that is attached to the hull 12 using fasteners 32. The intake housing 30 has an inlet opening 36 that provides a path for sea water to flow into an intake duct 34 located within the intake housing 30. Sea water flows upward and rearward through the intake duct 34 to an impeller 38. The impeller 38 is rotatably driven by a drive shaft 40. The drive shaft 40 passes through a drive shaft opening 42 in the intake housing 30, and is coupled to the engine output shaft 25 via coupler 44. The preferred intake housing 30 is disclosed in detail in copending patent application No. 08/710,868 entitled "Intake Housing For Personal Watercraft" by James R. Jones, and assigned to the assignee of the present application.

The impeller 38 rotates within a wear ring 46. The wear ring 46 is attached rearward of the intake duct 34 in the intake housing 30. A stator 48 is attached rearward of the wear ring 46. The impeller 38 is supported by a journal beating 50 in the stator 48. A nozzle 52 is attached rearward of the stator 48. The wear ring 46, the stator 48, and the nozzle 52, are attached to the intake housing 30 using attachment bolts 53 extending through outer flanges in the intake housing 30, the wear ring 46, the stator 48, and the nozzle 52.

The impeller 38 accelerates sea water flowing through the intake housing 30 as the impeller 38 rotates within the wear ring 46. The stator 48 has several stationary vanes 49, preferably seven (7) vanes, to remove swirl from the accelerated sea water. The preferred stator 48 is disclosed in detail in copending patent application Ser. No. 08/710,869, entitled "Stator And Nozzle Assembly For A Jet Propelled Personal Watercraft", by James R. Jones, and assigned to the assignee of the present application. The flow area through the stator 38 is preferably converging. When the sea water exits the stator 48, it flows through nozzle 52 and continues to converge. Sea water exiting nozzle 52 can be directed by rotating rudder 54 about a vertical axis to steer the personal watercraft 10. Rudder 54 is rotated by actuating steering arm 55.

A reverse bucket 56 is mounted to the rudder 54 along a horizontal axis 58. Referring in particular to FIG. 2, an actuating arm 60 is connected to a flange 62 on reverse bucket 56. The reverse bucket 56 can be moved into the down or reverse position 64 (illustrated in phantom in FIG. 2) by pulling on actuating arm 60. In a similar fashion, reverse bucket 56 can be raised by pushing actuating arm 60 rearward.

An exhaust adapter 64 is mounted to the top surface of the inlet housing 30. The exhaust adapter 64 receives engine exhaust from the engine 22 and guides the exhaust into the intake housing 30 around the intake duct 34. Cooling water is bled to the engine 22 from the stator 48 through nipple 66. Cooling water returns from the engine to the exhaust adapter 64 through nipple 68.

A siphoning tube 70 attached through the nozzle 52 provides a venturi effect to siphon water within the bilge of the watercraft 10. Tube 70 is connected through the top of the intake housing 30 using fitting 72, and another tube 74 attached to fitting 72 is connected to a bilge member 76 having a screened opening located in the bilge of the watercraft 10. A siphon brake is provided in the tube 74 to prevent the watercraft 10 from inadvertent flooding when the watercraft 10 is at rest.

Figure 5:
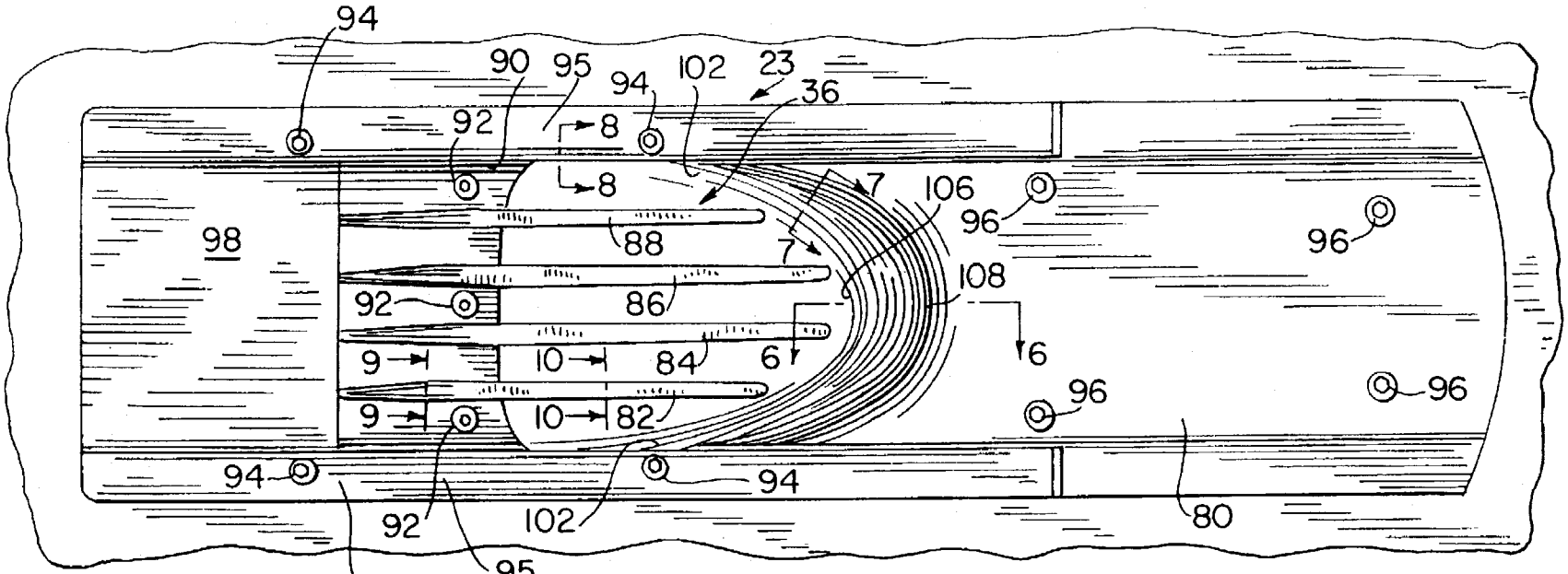
FIG. 5 is a bottom view showing an inlet adapter in accordance with the invention.
Figure 11:
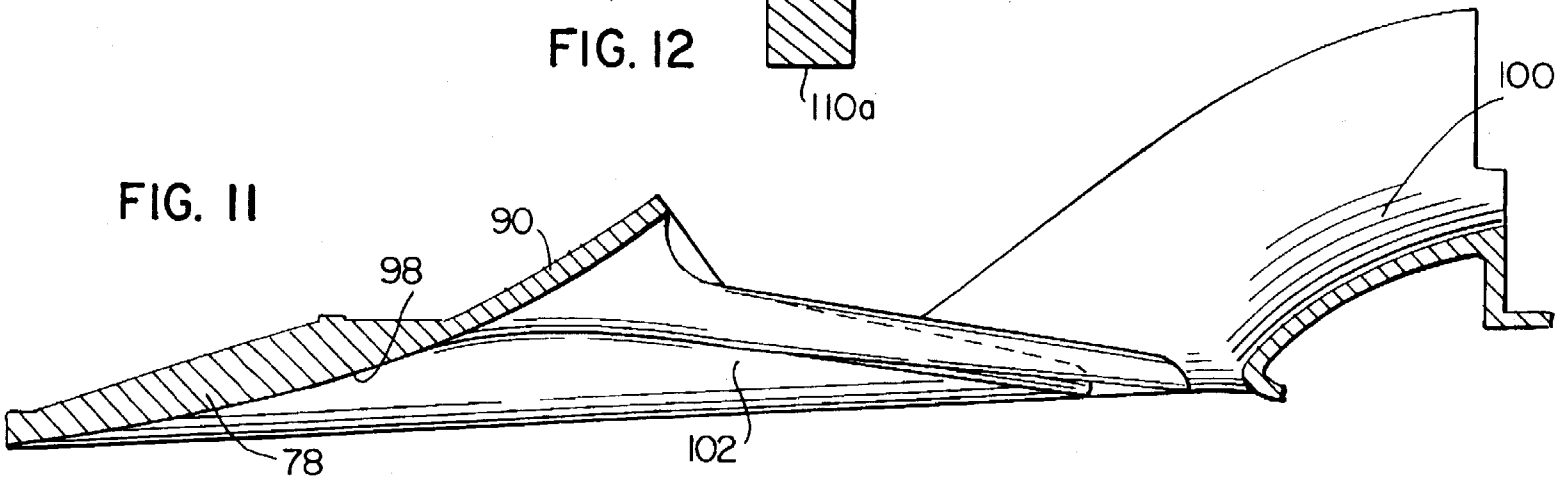
FIG. 11 is a sectional view of another embodiment of the invention.

Referring to FIGS. 4 and 5, the inlet adapter system 28 includes an inlet adapter plate or base 78, a ride plate 80, and a plurality of tines 82, 84, 86, and 88 that extend longitudinally from the inlet adapter base 78 rearward to cover the inlet opening 36. Inlet adapter plate 78 is attached to the hull 12 of the watercraft 10 using fasteners 94. Fasteners 94 are secured through mounting flanges 95. The mounting flanges 95 are generally flush with the hull 12 of the watercraft 10. The ride plate 80 is attached to the hull 12 of the watercraft 10 using fasteners 96. The ride plate 80 is generally flush with the hull 12 of the watercraft 10. The drawings show the inlet adapter base 78 and the ride plate 80 as being separate parts, however, it may be desirable that the inlet adapter plate 78 and the ride plate 80 be integral parts. The tines 82, 84, 86 and 88 are preferably integral components of a tine assembly 90 that is secured to the adapter plate base 78. The tine assembly 90 can be secured to the adapter plate base 78 using fasteners 92. The adapter inlet base 78 is preferably made of aluminum, but injection molded plastic as well as other materials may be suitable. The tine assembly 90 is preferably made of stainless steel, however, it can also be made of another suitable material such as injection molded plastic or aluminum. The ride plate 80 is preferably made of stamped aluminum. Alternatively, the tine assembly and the inlet adapter plate 78 may be a singular integral part. FIG. 11 illustrates an inlet adapter plate in which the tine assembly 90 is integral with the inlet adapter plate 78. The integral adapter plate 78 and tine assembly 90 shown in FIG. 11 would preferably be made of injection molded plastic.

The inlet adapter plate 78 has an upstream wall 98 that slopes gradually upward from the bottom of the hull 12 even before the upstream wall 98 progresses rearward to the base of the tines 82, 84, 86 and 88, see FIG. 4. The upstream wall 98 is therefore recessed above the mounting flanges 95. The base of the tines 82, 84, 86 and 88 are located at a position above the level of the bottom of the hull 12. The tines 82, 84, 86 and 88 extend slightly downward as the tines extend rearward.

The inlet adapter plate 78 also has a downstream wall 100 (FIG. 11) that is generally crescent-shaped. The inlet adapter plate 78 has converging sidewalls 102 that extend from the upstream wall 98 to the crescent-shaped downstream wall 100.

The bottom of the downstream wall 100 and the intersection of the mounting flanges 95 and the sidewall 102 defines a peripheral edge 106 of the inlet opening 36 that is bullet-shaped. Referring in particular to FIG. 5, middle tines 84 and 86 are longer than outer tines 82 and 88 to correspond with the shape of the peripheral edge 106 of inlet opening 36. Note that the downstream ends of the tines 82, 84, 86 and 88 do not attach to the downstream of the inlet opening 36, thereby preventing debris from catching on the tines 82, 84, 86 and 88 as water flows through the tines into the intake duct 34.

Figure 7:
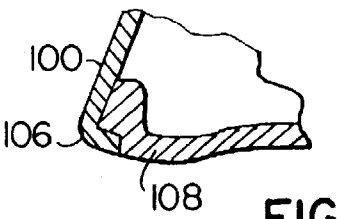
FIG. 7 is a detailed view taken along line 7—7 of FIG. 5.
Figure 6:
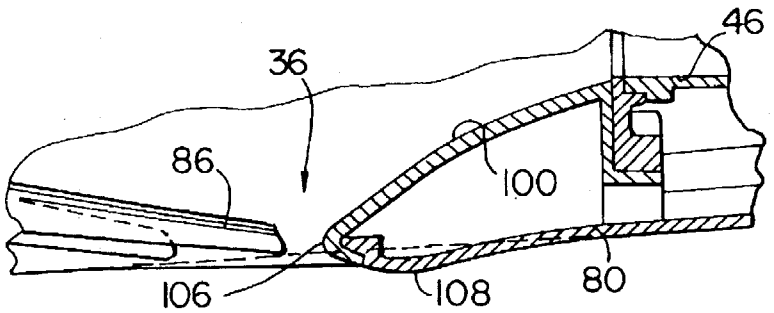
FIG. 6 is a detailed view taken along line 6—6 of FIG. 5.
Figure 8:
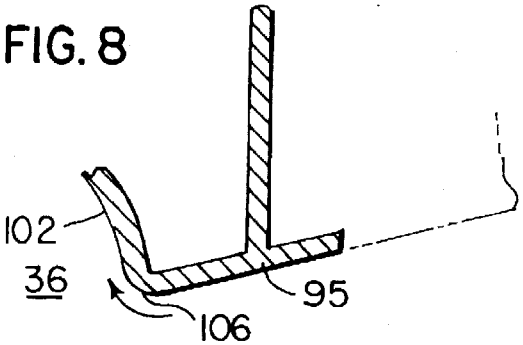
FIG. 8 is a detailed view taken along line 8—8 of FIG. 5.

The peripheral edge 106 of the intake opening 36 is radiused to promote the free flow of water into the inlet opening 36, especially at low speeds. Refer now in particular to FIGS. 6, 7 and 8 which are sectional views of the peripheral edge 106 of the inlet opening 36 taken at the locations indicated in FIG. 5. FIG. 8 shows that the peripheral edge 106 at the sidewall 102 of the inlet opening 36 is radiused, thus allowing water to more easily flow into the inlet opening 36 when the watercraft 10 is stopped or moving at slow speeds. Likewise, FIGS. 6 and 7 show a peripheral edge 106 at the downstream wall 100 of the inlet opening 36 being radiused.

FIGS. 6 and 7 also show a hydrodynamic bulge 108 that is adjacent the downstream edge 106 of the inlet opening 36. The purpose of the hydrodynamic bulge 108 is to hydrodynamically create a region of low fluid pressure below the downstream edge 106 of the inlet opening 36, especially at higher speeds. Creation of the low pressure region by the hydrodynamic bulge 108 reduces the amount of water accumulating against the downstream edge 106 of the inlet opening 36 at high watercraft speeds by pulling any such accumulated water downward. The hydrodynamic bulge 108 reduces the amount of water resistance or drag at the downstream edge 106 of the inlet opening 36, and therefore improves performance at high watercraft speeds. The hydrodynamic bulge 108 is most severely defined near the centerline of the ride plate 80 immediately downstream of the inlet opening 36. The bulge 108 tapers to be smaller in size as the bulge 108 extends around the downstream edge 106 of the intake opening 36 towards the edges by the sidewalls 102. FIG. 7 specifically shows that the hydrodynamic bulge 108 is smaller at an intermediate location.

Figure 10:
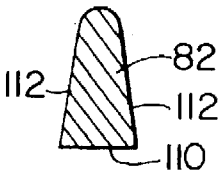
FIG. 10 is a detailed view taken along line 10—10 of FIG. 5.
Figure 9:
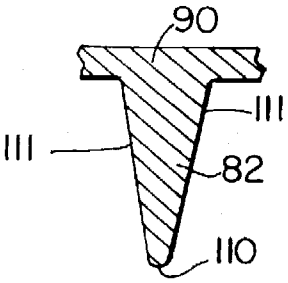
FIG. 9 is a detailed view taken along line 9—9 of FIG. 5.

FIGS. 9 and 10 illustrate a first embodiment of tines 82, 84, 86 and 88. FIGS. 9 and 10 are cross—sections of the tine 82 as indicated in FIG. 5, however, the other tines 84, 86 and 88 have generally the same configuration. Each tine 82, 84, 86 and 88 has a face 110 that is exposed to the flow of sea water flowing into the inlet opening 36. FIG. 9 shows that the tine is tapered near an upstream edge of the inlet opening 36. That is, the tine sidewalls diverge as the tine progresses upward towards the base 90. This provides increased strength at the location where the tines attach to the base 90. In FIG. 9, the exposed tine face 110 is rounded. The rounded tine face 110 as well as the tapered sidewalls 111 facilitate easy water flow over the tines 82, 84, 86 and 88 into the inlet opening 36 when the personal watercraft 10 is stopped or moving at a slow speed. FIG. 10 illustrates a cross—section through the tine 82 further downstream in a location where the tine is directly covering the inlet opening 36. The face 110 of the tine 82 in the region directly covering the inlet opening 36 is blunt, preferably flat. The blunt face 110 shown in FIG. 10 effectively blocks excess water from entering through the inlet opening 36 when the watercraft 10 is traveling at relatively high speeds (e.g., at speeds above about 28 mph) which is typically when sea water enters the inlet opening faster than the impeller can pump in conventional personal watercraft without use of the invention. It has been found that the blunt face 110 shown in FIG. 10 on the tines 82, 84, 86 and 88 does not substantially affect the flow of water into the intake opening 36 at relatively slow speeds. However, as the speed of the watercraft increases, the tine face 110 progressively restricts the flow of water into the intake duct 34. Referring in particular to FIG. 10, each of the tines has a pair of converging side surfaces 112 extending upward from the exposed face 110 of the tine 82. The purpose of the converging side surfaces 112 is to promote laminar flow within the intake duct 34 of the intake housing 30 as the water flows towards the impeller 38 of the pump.

Figure 12:
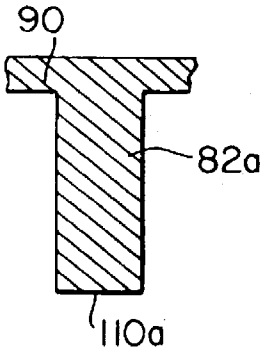
FIG. 12 is a view similar to FIG. 9 illustrating another embodiment of the invention.

FIG. 12 illustrates another tine configuration. FIG. 12 is a cross-section corresponding to the cross-section shown in FIG. 9. In FIG. 12, the tine **82*a* has a blunt exposed face 110*a* even at a location upstream of the inlet opening 36. Further downstream where the tine 82 is directly covering the inlet opening 35, the cross-section would preferably be similar to that shown in FIG. 10. While the configuration shown in FIG. 12 may somewhat restrict water flow into the inlet opening 36 when the watercraft 10 is moving at relatively slow watercraft speeds, the configuration in FIG. 12 provides additional water flow restriction through the inlet opening 36** at relatively high watercraft speeds.

From the above discussion, it should be understood that the inlet opening 36 is fixed in size. However, the invention provides several hydrodynamic features that effectively restrict excessive flow of sea water into the inlet opening 36 when the watercraft is moving forward at relatively high speeds (e.g., speeds faster than the impeller 38 can pump the sea water).

It is recognized that various alternatives and modifications of the invention are possible in accordance with the true spirit of the invention. Such modifications or alternatives should be considered to be within the scope of the following claims.

I claim:

1. In a jet propelled watercraft having a pump and an impeller, an inlet opening through the underside of the watercraft that allows seawater to flow to the pump, and a rudder outlet that allows sea water to flow from the after the impeller has provided energy to the flow of sea water through the pump, an inlet adapter system comprising:

an inlet adapter base attached to the underside of the watercraft;

a plurality of tines extending longitudinally from the inlet adapter base and covering the inlet opening, each tine having a face that is exposed to the flow of sea water flowing into the inlet opening and a pair of converging side surfaces extending generally upward from the tine face, wherein each exposed face is rounded near upstream edge of the inlet opening and is flat near a downstream edge of the inlet opening.

2. In a jet propelled watercraft having a pump with an impeller, an inlet opening through the underside of the watercraft that allows sea water to flow to the pump and an outlet opening that allows sea water to flow from the pump after the impeller has provided energy to the flow of sea water through the pump, an inlet adapter system comprising:

an inlet adapter plate and a ride plate attached to the underside of the watercraft, the ride plate providing a generally flat ride surface downstream of the inlet opening;

a plurality of tines extending longitudinally from the inlet adaptor plate and covering the inlet opening, each tine having a face exposed to the flow of sea water into the inlet opening; and a hydrodynamic downward bulge on the underside of the watercraft adjacent a downstream edge of the inlet opening;

wherein the downstream edge of the inlet opening is bullet-shaped.

3. In a jet propelled watercraft having a pump with an impeller, an inlet opening through the underside of the watercraft that allows sea water to flow to the pump and an outlet opening that allows sea water to flow from the pump after the impeller has provided energy to the flow of sea water through the pump, an inlet adapter system comprising:

an inlet adapter plate and a ride plate attached to the underside of the watercraft, the ride plate providing a generally flat ride surface downstream of the inlet opening;

a plurality of tines extending longitudinally from the inlet adaptor plate and covering the inlet opening, each tine having a face exposed to the flow of sea water into the inlet opening; and a hydrodynamic downward bulge on the underside of the watercraft adjacent a downstream edge of the inlet opening;

wherein each exposed tine face is rounded near an upstream edge of the inlet opening and blunt for the remainder of the face.

4. In a jet propelled watercraft having a pump with an impeller, an inlet opening through the underside of the watercraft that allows sea water to flow to the pump and an outlet opening that allows sea water to flow from the pump after the impeller has provided energy to the flow of sea water through the pump, an inlet adapter system comprising:

an inlet adapter plate and a ride plate attached to the underside of the watercraft, the ride plate providing a generally flat ride surface downstream of the inlet opening;

a plurality of tines extending longitudinally from the inlet adaptor plate and covering the inlet opening, each tine having a face exposed to the flow of sea water into the inlet opening; and a hydrodynamic downward bulge on the underside of the watercraft adjacent a downstream edge of the inlet opening;

wherein each tine has a pair of converging side surfaces extending generally upward from the exposed tine face directly covering the inlet opening, and each exposed tine face directly covering the inlet opening is blunt.

5. In a jet propelled watercraft having a pump with an impeller, an inlet opening through the underside of the watercraft that allows sea water to flow to the pump and an outlet opening that allows sea water to flow from the pump after the impeller has provided energy to the flow of sea water through the pump, an inlet adapter system comprising:

an inlet adapter plate and a ride plate attached to the underside of the watercraft, the ride plate providing a generally flat ride surface downstream of the inlet opening;

a plurality tines extending longitudinally from the inlet adaptor plate and covering the inlet opening each tine having a face exposed to the flow of sea water into the inlet opening wherein the inlet opening has a peripheral edge that is radiused continuously around the inlet opening including a downstream edge;

a hydrodynamic downward bulge on the underside of the watercraft adjacent said downstream edge of the inlet opening for drawing sea water accumulated in front of said downstream edge on the inlet opening downward to reduce drag on the watercraft when the watercraft is moving forward at a relatively high speed.

6. In a jet propelled watercraft having a pump with an impeller, an inlet opening through the underside of the watercraft that allows sea water to flow to the pump and an outlet opening that allows sea water to flow from the pump after the impeller has provided energy to the flow of sea water through the pump an inlet adapter system comprising:

an inlet adapter plate and a ride plate attached to the underside of the watercraft, the ride plate providing a generally flat ride surface downstream of the inlet opening;

a plurality of tines extending longitudinally from the inlet adaptor plate and covering the inlet opening each tine having a face exposed to the flow of sea water into the inlet opening; and a hydrodynamic downward bulge on the underside of the watercraft adjacent a downstream edge of the inlet opening;

wherein the hydrodynamic bulge on the underside of the watercraft is located on the ride plate.

7. In a jet propelled watercraft having a pump with an impeller, an inlet opening through the underside of the watercraft that allows sea water to flow to the pump and an outlet opening that allows sea water to flow from the pump after the impeller has provided energy to the flow of sea water through the pump, an inlet adapter system comprising:

an inlet adapter plate and a ride plate attached to the underside of the watercraft, the ride plate providing a generally flat ride surface downstream of the inlet opening;

a plurality of tines extending longitudinally from the inlet adaptor plate and covering the inlet opening, each tine having a face exposed to the flow of sea water into the inlet opening; and a hydrodynamic downward bulge on the underside of the watercraft adjacent a downstream edge of the inlet opening;

wherein the inlet adaptor plate includes:

a mounting flange that is generally flush with the underside hull surface of the watercraft;

an upstream wall located primarily upstream of the inlet opening, the upstream wall having a fore edge that is generally flush with the underside surface of the watercraft and the mounting flange, the upstream wall becoming progressively recessed upward of the mounting flange and sloping gradually upward from the underside hull surface as the upstream wall extends towards the pump; and a crescent-shaped downstream wall located downstream of the inlet opening, the downstream wall having a lower edge that is the downstream edge of the inlet opening, the crescent-shaped downstream wall sloping upward from the downstream edge of the inlet opening towards the pump.

* * * * *

UNITED STATES PATENT AND TRADEMARK OFFICE

CERTIFICATE OF CORRECTION

PATENT NO. : 5,700,169

DATED : December 23, 1997

INVENTOR(S) : JAMES R. JONES

It is certified that error appears in the above-indentified patent and that said Letters Patent is hereby corrected as shown below:

Claim 1, Col. 6, Line 39, after "near" and before "upstream" insert ---an---; Claim 5, Col. 7, Line 48, after "plurality" and before "tines" insert ---of---; Claim 5, Col. 7, Line 49, after "opening" insert ---,--- (comma); Claim 6, Col. 8, Line 6, after "pump" insert ---,--- (comma)

Signed and Sealed this

Thirtieth Day of June, 1998

*Attest:*

Bruce Lehman

BRUCE LEHMAN

*Attesting Officer*

*Commissioner of Patents and Trademarks*